US007109667B2

(12) United States Patent
Matsushima et al.

(10) Patent No.: US 7,109,667 B2
(45) Date of Patent: Sep. 19, 2006

(54) DISCHARGE LAMP DRIVING APPARATUS

(75) Inventors: Mitsuo Matsushima, Shizuoka-ken (JP); Kohei Nishibori, Shizuoka-ken (JP)

(73) Assignee: Minebea Co., Ltd., Nagano-ken (JP)

( * ) Notice: Subject to any disclaimer, the term of this patent is extended or adjusted under 35 U.S.C. 154(b) by 0 days.

(21) Appl. No.: 11/053,171

(22) Filed: Feb. 8, 2005

(65) Prior Publication Data

US 2005/0184684 A1 Aug. 25, 2005

(30) Foreign Application Priority Data

Feb. 20, 2004 (JP) ..... 2004-044168

(51) Int. Cl.
*H05B 37/02* (2006.01)
*H05B 37/00* (2006.01)

(52) U.S. Cl. ..... 315/224; 315/226; 315/259; 315/277; 315/248; 315/308; 315/312; 315/DIG. 7

(58) Field of Classification Search ..... 315/209 R, 315/210–213, 219–220, 224, 226, 243, 244, 315/255, 258–259, 277–278, 283–284, 287, 315/291, 307–308, DIG. 7, 312, 324
See application file for complete search history.

(56) References Cited

U.S. PATENT DOCUMENTS 4,016,477 A * 4/1977 Ghiringhelli ..... 363/64
4,547,705 A * 10/1985 Hirayama et al. ..... 315/219
6,310,444 B1 10/2001 Chang ..... 315/282
6,515,427 B1 * 2/2003 Oura et al. ..... 315/141
6,703,796 B1 * 3/2004 Che-Chen et al. ..... 315/291
6,717,372 B1 * 4/2004 Lin et al. ..... 315/282
6,731,075 B1 * 5/2004 Pak ..... 315/274
6,784,627 B1 * 8/2004 Suzuki et al. ..... 315/291
2003/0001524 A1 1/2003 Lin et al. ..... 315/312
2003/0057869 A1 3/2003 Ito et al. ..... 315/224

FOREIGN PATENT DOCUMENTS

JP 11-260580 9/1999
JP 11-260586 9/1999

* cited by examiner

*Primary Examiner*—Thuy Vinh Tran
(74) *Attorney, Agent, or Firm*—Muirhead & Saturnelli, LLC

(57) ABSTRACT

A discharge lamp driving apparatus comprises a DC power supply, a control circuit, switching elements, a step-up transformer, and a lamp current controlling circuit. In the discharge lamp driving apparatus, the secondary side of the step-up transformer is connected to multiple discharge lamps respectively via variable inductance elements, a series resonant circuit is constituted by a capacitor provided between the variable inductance element and the discharge lamp, leakage inductance of the step-up transformer, and inductance of the variable inductance element, and an output of the lamp current controlling circuit is connected to the variable inductance element, wherein the inductance of the variable inductance element is varied thereby controlling the lamp current of the discharge lamp.

12 Claims, 6 Drawing Sheets

DISCHARGE LAMP DRIVING APPARATUS

BACKGROUND OF THE INVENTION

1. Field of the Invention

The present invention relates to a discharge lamp driving apparatus for lighting a discharge lamp to illuminate a liquid crystal display (LCD) apparatus, and more specifically to a discharge lamp driving apparatus for lighting multiple discharge lamps.

2. Description of the Related Art

The LCD apparatus is one of flat panel display apparatuses, and is extensively used. Since a liquid crystal used in the LCD apparatus does not emit light by itself, a lighting device is required for ensuring a good screen display. A backlight system is one of such lighting devices, and illuminates the liquid crystal from behind. The backlight system uses mainly a cold cathode fluorescent lamp (CCFL) as a discharge lamp, and is provided with a discharge lamp driving apparatus including an inverter to drive the CCFL.

Since the LCD apparatus is increasingly getting larger and larger in size to meet applications to, for example, a large TV, the backlight system uses multiple discharge lamps for achieving sufficient illumination intensity over the screen of the LCD apparatus. The discharge lamps are each required to emit highly luminous light with uniform luminance among them. Variation in luminance among the discharge lamps causes uneven brightness over the screen of the LCD apparatus, which raises display and visual problems thus significantly deteriorating the product quality. Also, to answer a demand for a reduced cost on the LCD apparatus, cost reduction on the discharge lamp driving apparatus incorporated in the backlight system is strongly requested.

Variation in luminance of the discharge lamps can be reduced by equalizing lamp currents flowing therein. The equalization is enabled by providing transformers in a number corresponding to the number of the discharge lamps and controlling the transformers by a control IC. This approach, however, involves an increase of components, and pushes up the cost on the discharge lamp driving apparatus. An alternative approach for enabling the equalization of lamp currents is proposed which is accomplished by providing balance coils, but the alternative approach must use a large number of balance coils for multiple discharge lamps, and to make matters worse the balance coils must come up with individually different specifications due to the lamp currents differing depending on the places where they are disposed. Consequently, the number of components is increased pushing up the cost on the discharge lamp driving apparatus.

A discharge lamp driving apparatus as another approach is proposed, in which inductance values are controlled by variable inductance elements, rather than balance coils, so as to control respective lamp currents for uniform brightness over the display screen (refer to, for example, Japanese Patent Application Laid-Open No. H11-260580).

FIG. 1 is a block diagram of a discharge lamp driving apparatus which is disclosed in the aforementioned Japanese Patent Application Laid-Open No. H11-260580, and in which two discharge lamps are provided.

Referring to FIG. 1, FET's 102 and 103 constituting switching elements are connected in series between the positive and negative electrodes of a DC power supply 101, and the connection midpoint between the source terminal of the FET 102 and the drain terminal of the FET 103 is connected to the negative electrode of the DC power supply 101 via a series resonant circuit 120A which consists of a capacitor 122*a* and a coil 121*a* of an orthogonal transformer 121A which constitutes an variable inductance capable of controlling inductance value, and also via a series resonant circuit 120B which consists of a capacitor 122*b* and a coil 121*a* of an orthogonal transformer 121B which constitutes an variable inductance.

A connection midpoint between the coil 121*a* of the orthogonal transformer 121A and the capacitor 122*a* is connected to the negative electrode of the DC power supply 101 via a series circuit consisting of a capacitor 110*a*, a discharge lamp 111*a*, and a current detecting resistor 123*a* of a control circuit 123A, and an output signal of the control circuit 123A is sent to a control coil 121*b* of the orthogonal transformer 121A.

The control circuit 123A supplies a control current to the control coil 121*b* of the orthogonal transformer 121A, and is arranged such that a connection midpoint between the discharge lamp 111*a* and the current detecting resistor 123*a* is connected to the inverting input terminal of an operation amplification circuit 123*c* via a rectifying diode 123*b*, a connection midpoint between the rectifying diode 123*b* and the inverting input terminal of the operation amplification circuit 123*c* is connected to the negative electrode of the DC power supply 101 via a smoothing capacitor 123*d*, the non-inverting terminal of the operation amplification circuit 123*c* is connected to the negative electrode of the DC power supply 101 via a battery 123*e* having a reference voltage Vref to determine a reference value of a current of the discharge lamp 111*a*, and that the output terminal of the operation amplification circuit 123*c* is connected to the negative electrode of the DC power supply 101 via the control coil 121*b* of the orthogonal transformer 121A.

The control circuit 123A functions to control the current of the discharge lamp 111*a*. Specifically, the control circuit 123A operates such that, when the current of the discharge lamp 111*a* is to be increased, the control current of the control coil 121*b* of the orthogonal transformer 121A is increased so as to decrease the inductance value of the coil 121*a* of the orthogonal transformer 121A thereby increasing the resonant frequency $f_0$ of the series resonant circuit 120A thus decreasing the impedance of the series resonant circuit 120A at a driving frequency consequently resulting in an increase of a voltage generated between the both ends of the capacitor 122*a*, and such that, when the current of the discharge lamp 111*a* is to be decreased, the control current of the control coil 121*b* of the orthogonal transformer 121A is decreased so as to increase the inductance value of the coil 121*a* of the orthogonal transformer 121A thereby decreasing the resonant frequency $f_0$ of the series resonant circuit 120A thus increasing the impedance of the series resonant circuit 120A at a driving frequency consequently resulting in a decrease of a voltage generated between the both ends of the capacitor 122*a*.

There is provided another circuit which includes another orthogonal transformer 121B, and which is constituted same as the above-described circuit including the orthogonal transformer 121A. Specifically, a connection midpoint between the coil 121*a* of the orthogonal transformer 121B and the capacitor 122*b* is connected to the negative electrode of the DC power supply 101 via a series circuit consisting of a capacitor 110*b*, a discharge lamp 111*b*, and a current detecting resistor 123*a* of a control circuit 123B, and an output signal of the control circuit 123B is sent to a control coil 121*b* of the orthogonal transformer 121B.

The control circuit 123B supplies a control current to the control coil 121*b* of the orthogonal transformer 121B, and is arranged such that a connection midpoint between the discharge lamp 111*b* and the current detecting resistor 123*a* is connected to the inverting input terminal of an operation amplification circuit 123*c* via a rectifying diode 123*b*, a connection midpoint between the rectifying diode 123*b* and the inverting input terminal of the operation amplification circuit 123*c* is connected to the negative electrode of the DC power supply 101 via a smoothing capacitor 123*d*, the non-inverting terminal of the operation amplification circuit 123*c* is connected to the negative electrode of the DC power supply 101 via a battery 123*e* having a reference voltage Vref to determine a reference value of a current of the discharge lamp 111*a*, and that the output terminal of the operation amplification circuit 123*c* is connected to the negative electrode of the DC power supply 101 via the control coil 121*b* of the orthogonal transformer 121B.

The control circuit 123B functions to control the current of the discharge lamp 111*b*. Specifically, the control circuit 123B operates such that, when the current of the discharge lamp 111*b* is to be increased, the control current of the control coil 121*b* of the orthogonal transformer 121B is increased so as to decrease the inductance value of the coil 121*a* of the orthogonal transformer 121B thereby increasing the resonant frequency $f_0$ of the series resonant circuit 120B thus decreasing the impedance of the series resonant circuit 120B at a driving frequency consequently resulting in an increase of a voltage generated across the both ends of the capacitor 122*b*, and such that, when the current of the discharge lamp 111*b* is to be decreased, the control current of the control coil 121*b* of the orthogonal transformer 121B is decreased so as to increase the inductance value of the coil 121*a* of the orthogonal transformer 121B thereby decreasing the resonant frequency $f_0$ of the series resonant circuit 120B thus increasing the impedance of the series resonant circuit 120B at a driving frequency consequently resulting in a decrease of a voltage generated across the both ends of the capacitor 122*b*.

Also, in the discharge lamp driving apparatus shown in FIG. 1, a control circuit 104 fixedly sets a switching frequency of a control signal to be supplied to the FET's 102 and 103 whereby the currents flowing in the discharge lamps 111*a* and 111*b* are controlled at a predetermined value without controlling the switching frequency, thus allowing the circuit to be structured without complicated frequency control performed at the control circuit 104, and achieving uniform brightness between the discharge lamps 111*a* and 111*b*.

Depending on the specifications of CCFL'S, a voltage to turn on the CCFL is generally higher than a voltage to keep it lighted. Specifically, the voltage to turn on the CCFL ranges from about 1,500 to 2,500 V while the voltage to keep it lighted ranges from about 600 to 1,300 V. Accordingly, a high-voltage power supply is required in a discharge lamp driving apparatus.

Since the discharge lamp driving apparatus shown in FIG. 1 is not provided with a step-up circuit, the DC power supply 101 has a circuitry to output a high voltage in order to duly drive the discharge lamps 111*a* and 111*b*.

Also, since the FET's 102 and 103 to turn on the discharge lamps 111*a* and 111*b*, and the control circuit 104 to control the FET's 102 and 103 are connected to the DC power supply 101 to output a high voltage, the FET's 102 and 103 and the control circuit 104 must be composed of high-voltage-resistant materials which are expensive thus pushing up the cost of the apparatus.

Further, in the discharge lamp driving apparatus shown in FIG. 1, the capacitors 110*a* and 110*b*, which are current controlling capacitors (so-called "ballast capacitors") to stabilize the lamp current of the discharge lamps 111*a* and 111*b*, are connected in series to the discharge lamps 111*a* and 111*b*, respectively, and a high voltage is applied to the capacitors 110*a* and 110*b*. Consequently, the capacitors 110*a* and 110*b* must also be composed of high-voltage-resistant materials, and since the current controlling capacitors must be provided in a number equal to the number of discharge lamps to be driven, the cost of the apparatus is pushed up definitely. Also, since a high voltage is applied to the capacitors 110*a* and 110*b* as described above, there is a problem also in terms of component safety.

SUMMARY OF THE INVENTION

The present invention has been made in light of the above problems, and it is an object of the present invention to provide a discharge lamp driving apparatus, in which currents flowing in multiple discharge lamps are equalized for minimizing variation in luminance among the discharge lamps, and which can be inexpensively produced by restricting the number of high-voltage-resistant components.

In order to achieve the object described above, according to one aspect of the present invention, there is provided a discharge lamp driving apparatus which comprising: a DC power supply; a control circuit; at least one step-up transformer; switching elements which are connected to the DC power supply and drive a primary side of the step-up transformer in accordance with a signal from the control circuit thereby driving at least two discharge lamps provided at a secondary side of the step-up transformer; at least two variable inductance elements which each have its one end connected to one end of the secondary side of the step-up transformer whose other end is grounded, and which each have its other end connected to one end of each of the discharge lamps; at least two series resonant circuits which are each constituted by a capacitor provided between each variable inductance element and each discharge lamp, leakage inductance of the step-up transformer, and inductance of the each variable inductance element; at least two lamp current detecting blocks which are each provided at the other end of the each discharge lamp; and at least two lamp current controlling circuits which are each connected to an output of each lamp current detecting block, and which each have its output connected to the each variable inductance element, wherein the inductance of the each variable inductance element is varied thereby controlling a lamp current of the each discharge lamp.

In the one aspect of the present invention, a secondary side coil of the step-up transformer may be divided into a plurality of sections, and the at least two series resonant circuits, the at least two lamp current detecting blocks, and the at least two lamp current controlling circuits may be provided at respective sections of the secondary side coil of the step-up transformer.

In the one aspect of the present invention, each of the lamp current controlling circuits may comprise an operational amplifier and a transistor which has its base terminal connected to an output of the operational amplifier and which has its collector terminal connected to the variable inductance element, wherein a signal from the lamp current detecting block, and a reference voltage are inputted to the operational amplifier, whereby the inductance of the variable inductance element is varied.

In the one aspect of the present invention, each of the variable inductance elements may constitute a transformer, and both ends of a control coil of the transformer may be connected to a snubber circuit.

In the one aspect of the present invention, each of the lamp current detecting blocks may be provided at the grounded other end of the secondary side of the step-up transformer.

In the one aspect of the present invention, each of the variable inductance elements may be provided at the grounded other end of the secondary side of the step-up transformer.

In the one aspect of the present invention, the discharge lamp driving apparatus may be incorporated in a backlight system for a liquid crystal display device.

According to the present invention, the discharge lamp driving apparatus, in which currents flowing in multiple discharge lamps can be equalized for reduction in variation of brightness among the discharge lamps, can be produced inexpensively with a limited number of high-voltage-resistant components for the circuit.

According to one embodiment (hereinlater discussed with reference to FIG. 2) of the present invention, leakage inductance Le exists at the step-up transformer, and therefore the inductance for controlling lamp current can be regulated by the leakage inductance Le as well as inductance Lv of the variable inductance element, the variable inductance element can be downsized.

According to another embodiment (hereinlater discussed with reference to FIG. 3) of the present invention, the second side coil of the step-up transformer is divided into a plurality of sections, and with variation of the winding ratio in the coil sections, the lamp current control can be performed easily even when the lamp currents of the multiple discharge lamps are different from one another.

According to still another embodiment (hereinlater discussed with reference to FIG. 4) of the present invention, the return side wires of the discharge lamps are put together into a common wire thus decreasing the number of wires and wirings for cost reduction.

And, according to yet another embodiment (hereinlater discussed with reference to FIG. 5) of the present invention, the variable inductance elements are provided at the low-voltage side of the step-up transformer, and therefore the potential difference between the coils of the transformers constituting the variable inductance elements is small. Consequently, the transformers can be easily insulated internally, thus the variable inductance elements can be downsized and produced inexpensively.

DETAILED DESCRIPTION OF THE PREFERRED EMBODIMENTS

Figure 2:
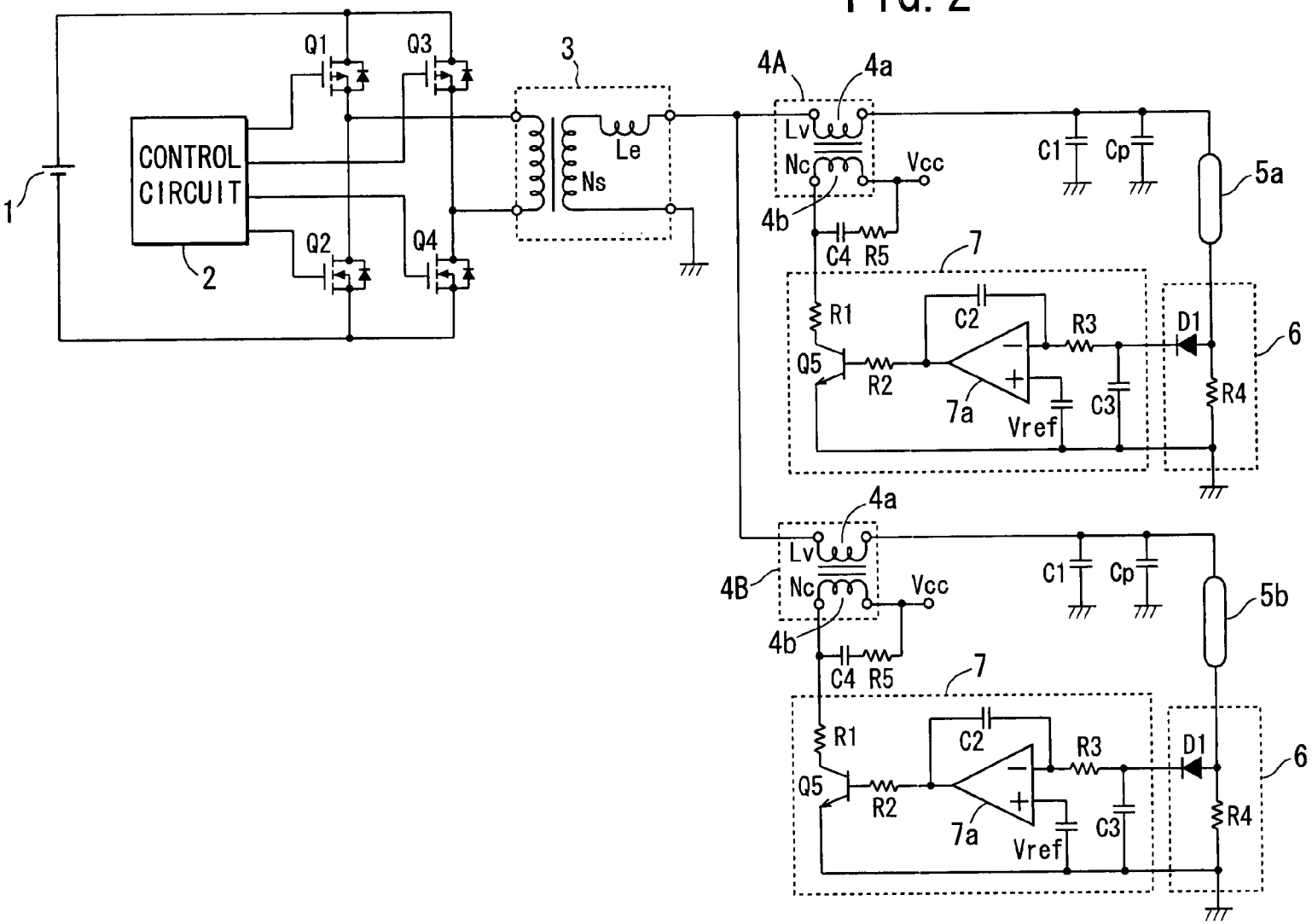
FIG. 2 is a block diagram of a discharge lamp driving apparatus according to a first embodiment of the present invention.

A first embodiment of the present invention will hereinafter be described with reference to FIG. 2. A discharge lamp driving apparatus shown in FIG. 2 is for driving two discharge lamps. A series circuit of transistors Q1 and Q2 as switching elements and a series circuit of transistors Q3 and Q4 as switching elements are connected in parallel to the both ends of a DC power supply 1, and a connection between the transistors Q1 and Q2 and a connection between the transistors Q3 and Q4 are connected to the primary side of a step-up transformer 3 thus constituting a so-called "full-bridge" arrangement.

A control circuit 2 is for controlling the discharge lamp driving apparatus, and comprises an oscillation circuit to set a driving frequency for driving the primary side of the step-up transformer 3, and the transistors Q1, Q2, Q3 and Q4 are switched on and off at a predetermined time interval by an output signal from the control circuit 2 thereby generating an AC voltage. In this connection, needless to say, the switching operation can be performed with the Q1, Q2, Q3 and Q4 structured in a "half-bridge" arrangement, but the full-bridge arrangement performs the switching operation more efficiently and therefore is preferred.

Two circuitries respectively including discharge lamps 5*a* and 5*b* are provided at the secondary side of the step-up transformer 3. The two circuitries are constituted identically with each other, and a description will be made only on one circuitry including the discharge lamp 5*a*.

One end of the secondary side of the step-up transformer 3 is connected to one end of the discharge lamp 5*a* via a coil 4*a* of a transformer 4A as a variable inductance element, and the other end of the secondary side of the step-up transformer 3 is grounded. At the secondary side of the step-up transformer 3, a series resonant circuit is formed, which consists of a leakage inductance Le of the step-up transformer 3, an inductance Lv of the transformer 4A, and capacitors C1 and Cp. The capacitor C1 is connected to the circuit and regulates resonant frequency, and the capacitor Cp is a stray capacitance.

At the other end of the discharge lamp 5*a* there is provided a lamp current detecting block 6, which consists of a lamp current detecting resistor R4 and a rectifying diode D1. A lamp current of the discharge lamp 5*a* is converted to a voltage by the lamp current detecting resistor R4 while it is rectified by the rectifying diode D1. The lamp current detecting block 6 is connected to an operational amplifier 7*a* of a lamp current controlling circuit 7.

The operational amplifier 7*a* compares the voltage rectified by the rectifying diode D1 with a reference voltage Vref. The output of the operational amplifier 7*a* is connected to the base terminal of a transistor Q5 whose collector terminal is connected to a control coil 4*b* of the transformer 4A, whereby a value of the current flowing in the control coil 4*b* of the transformer 4A as a variable inductance element is varied thus controlling an inductance value of the transformer 4A. A snubber circuit, which consists of a capacitor C4 and a resistor R5 connected in series to each other, and which is adapted to prevent a high spike voltage at the generation of back EMF, is provided at the both ends of the control coil 4*b* of the transformer 4A.

The operation of the transformer 4A as a variable inductance element will now be described. The transformer 4A operates such that its inductance value decreases when the current value of the control coil 4*b* increases.

When the lamp current flowing in the discharge lamp 5*a* falls below a predetermined value, the voltage of the lamp current detecting resistor R4 drops, the output of the operational amplifier 7*a* rises, and the base current of the transistor Q5 increases causing an increase in its collector current. Thus, an increase of the current flowing in the control coil 4*b* of the transformer 4A causes a decrease in inductance value of the transformer 4A as a variable inductance element. As a result, a resonant frequency $f^0(=1/2\pi\{(Le+Lv)\times(C1+Cp)\}^{1/2}$ of the resonant circuit provided at the secondary side of the step-up transformer 3 increases. Since the driving frequency at the primary side of the step-up transformer 3 is set to be higher than the resonant frequency $f_0$ of the resonant circuit at the secondary side of the step-up transformer 3, the resonant frequency $f_0$ of the resonant circuit at the secondary side gets closer to the driving frequency at the primary side, which results in that the impedance of the resonant circuit at the driving frequency drops thereby increasing the lamp current in the discharge lamp 5*a*.

On the other hand, when the lamp current flowing in the discharge lamp 5*a* rises above a predetermined value, the voltage of the lamp current detecting resistor R4 rises, the output of the operational amplifier 7*a* drops, and the base current of the transistor Q5 decreases causing a decrease in its collector current. Thus, a decrease of the current flowing in the control coil 4*b* of the transformer 4A causes an increase in inductance value of the transformer 4A as a variable inductance element. As a result, a resonant frequency $f_0$ of the resonant circuit provided at the secondary side decreases, and therefore the resonant frequency $f_0$ of the resonant circuit at the secondary side of the step-up transformer 3 gets away from the driving frequency at the primary side, which results in that the impedance of the resonant circuit at the driving frequency rises thereby decreasing the lamp current in the discharge lamp 5*a*.

Since the lamp current in the discharge lamp is controlled on a lamp-by-lamp basis, the lamp current control can be performed with a high degree of accuracy so that the lamp currents of multiple discharge lamps can be equalized thereby minimizing variation in brightness among the multiple discharge lamps.

Figure 1:
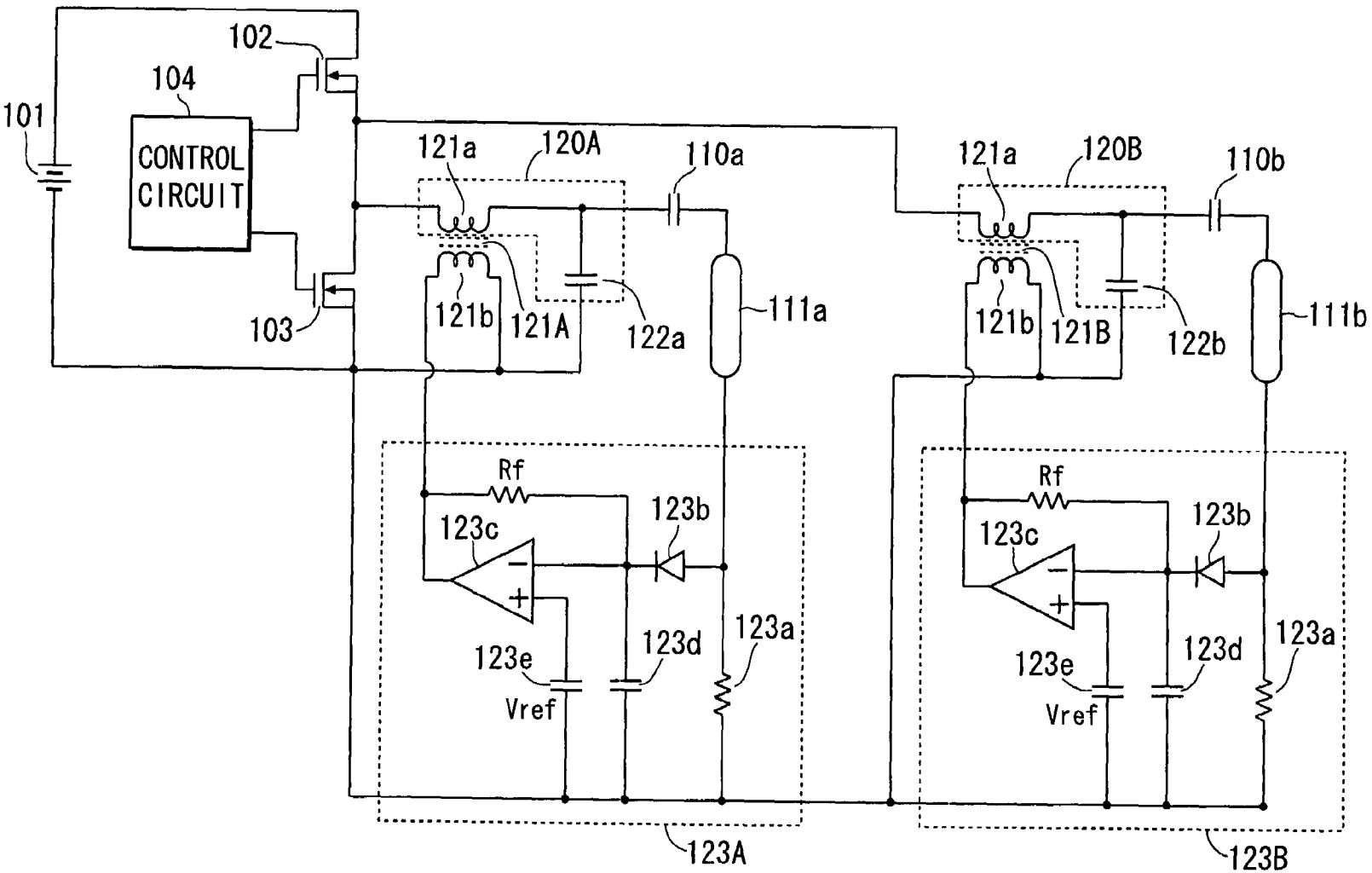
FIG. 1 PRIOR ART
FIG. 1 is a block diagram of a conventional discharge lamp driving apparatus.

The discharge lamp driving apparatus shown in FIG. 2 according to the present invention is similar to the apparatus shown in FIG. 1 in that the lamp current of the discharge lamp is controlled by varying the inductance value of the transformer 4A as a variable inductance element, but eliminates the capacitors 110*a* and 110*b* for limiting current, which are connected in series to the discharge lamps 111*a* and 111*b*, and required for stabilizing the lamp current of the discharge lamps 111*a* and 111*b* in the apparatus shown in FIG. 1.

Also, in the discharge lamp driving apparatus shown in FIG. 1, the resonant frequency $f_0$ of the series resonant circuit 120A is represented by $$f_0=1/2\pi(Lv\times C1)^{1/2}$$

where Lv is the inductance of the orthogonal transformer 121A, and C1 is the capacitance of the capacitor 122*a*. Thus, the resonant frequency is varied by varying only the inductance Lv of the orthogonal transformer 121A, which means that the lamp current is controlled by means of the inductance Lv of the orthogonal transformer 121A alone. On the other hand, in the discharge lamp driving apparatus shown in FIG. 2, the circuitry includes the step-up transformer 3, and the resonant frequency $f_0$ of the resonant circuit at the secondary side of the step-up transformer 3 is represented by $f_0=1/2\pi\{(Le+Lv)\times(C1+Cp)\}^{1/2}$ where Le is the leakage inductance at the step-up transformer 3. Since the leakage inductance Le exists at the step-up transformer 3, the lamp current can be controlled by means of the leakage inductance Le as well as the inductance Lv in combination. This allows the variable inductance element to be downsized. And, the leakage inductance Le of the set-up transformer 3 and the inductance Lv of the variable inductance element act as a capacitor for limiting current, so the capacitor can be eliminated.

Thus, the discharge lamp driving apparatus according to the present invention does not require a high-voltage resistant capacitor for limiting currents allows a variable inductance element to be downsized, and therefore can be inexpensively manufactured with a limited number of high-voltage resistant components.

The discharge lamp driving apparatus shown in FIG. 2 is for driving two discharge lamps, but can drive three or more discharge lamps with additional circuits connected in parallel to the secondary side of the step-up transformer 3.

Figure 3:
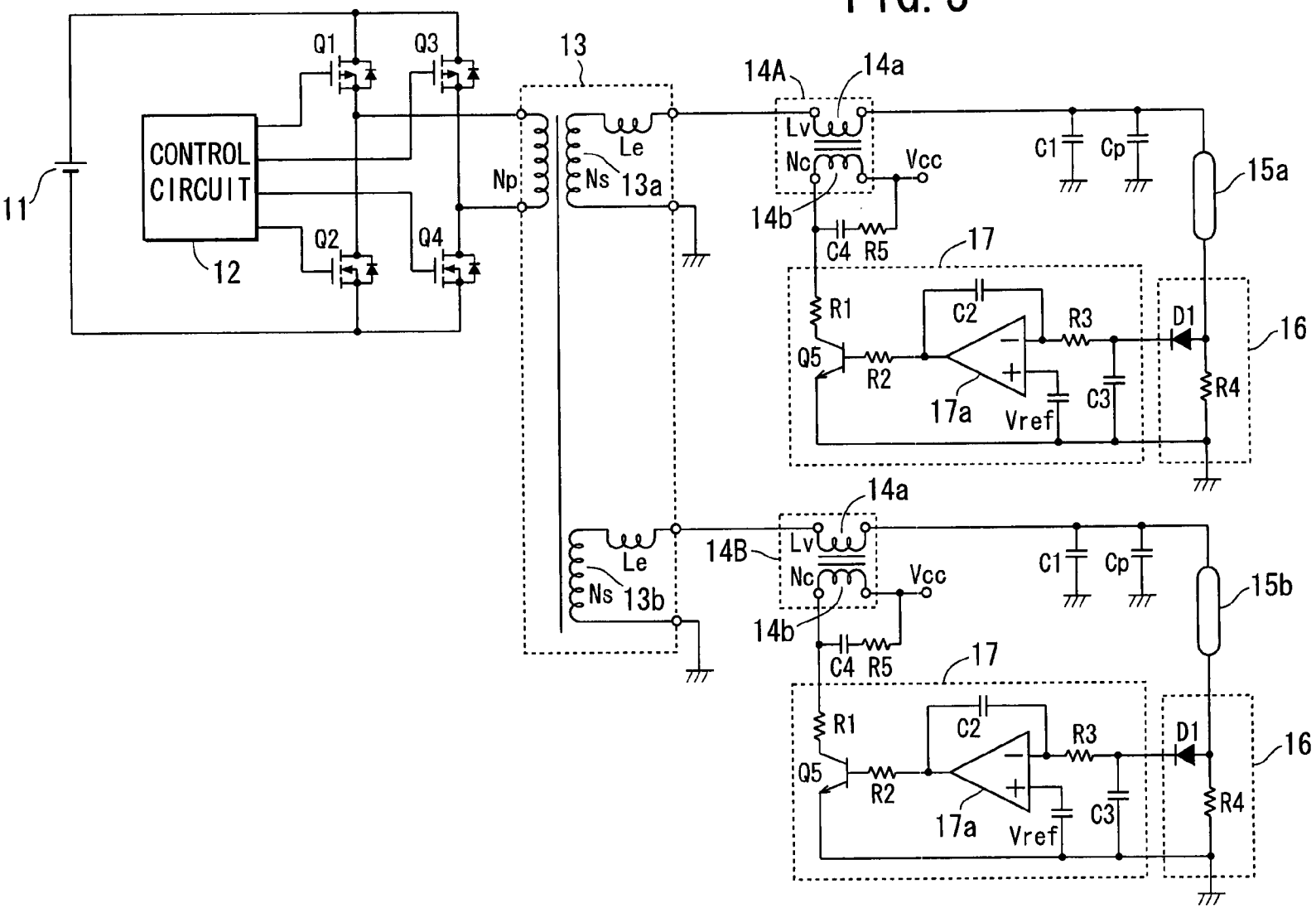
FIG. 3 is a block diagram of a discharge lamp driving apparatus according to a second embodiment of the present invention.

A discharge lamp driving apparatus according to a second embodiment of the present invention will be described with reference to FIG. 3. The discharge lamp driving apparatus shown in FIG. 3 operates basically in the same way as the apparatus shown in FIG. 2, but differs therefrom in that the secondary coil of the step-up transformer 13 is divided into two sections 13*a* and 13*b*. With this structure, a winding ratio between the two sections 13*a* and 13*b* can be changed thereby easily dealing with two different lamp currents of discharge lamps 15*a* and 15*b*.The discharge lamp driving apparatus shown in FIG. 3 is for driving two discharge lamps, but can drive three or more discharge lamps with the secondary coil of the step-up transformer 13 divided into a number of sections corresponding to the number of circuits with discharge lamps.

Figure 4:
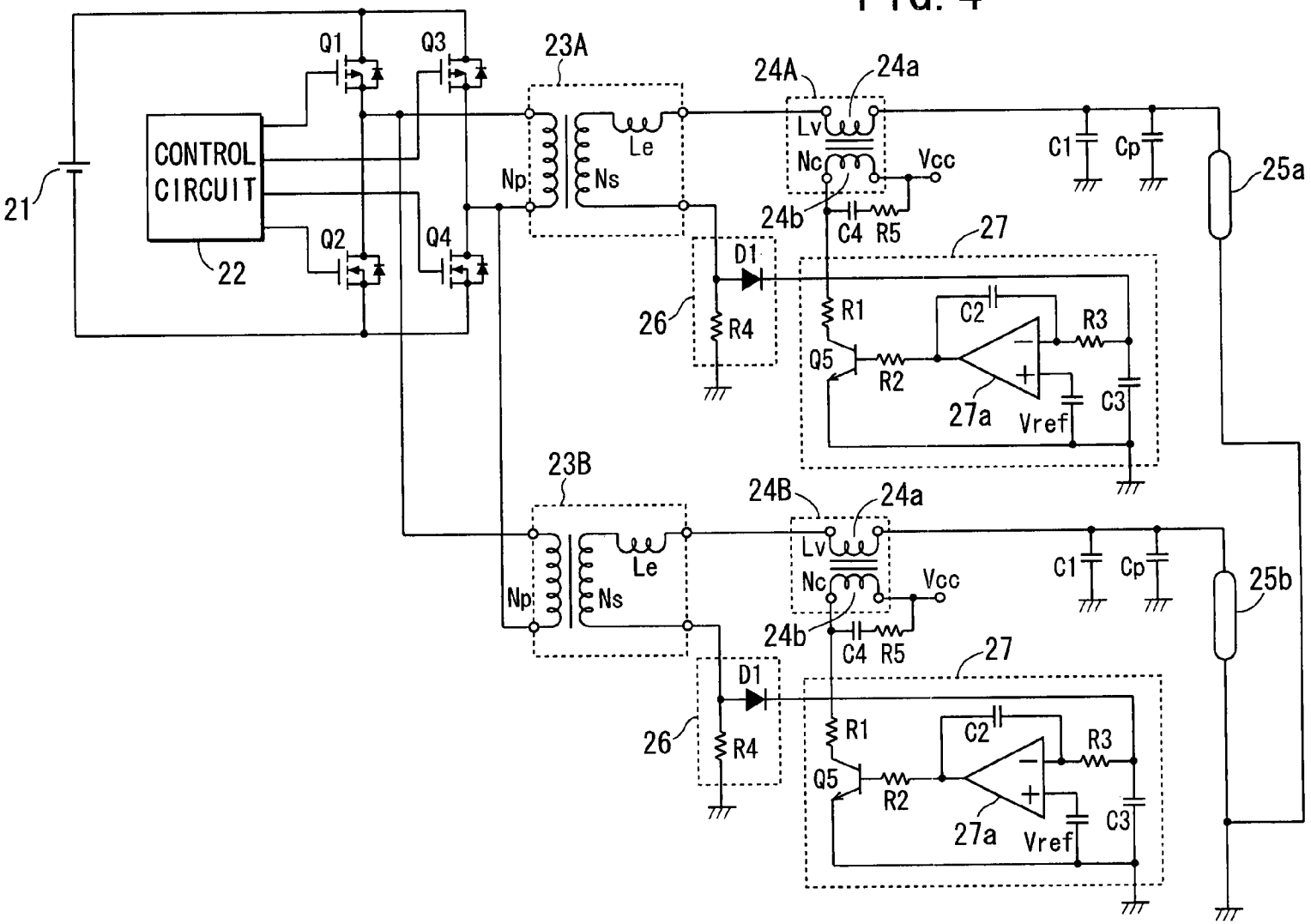
FIG. 4 is a block diagram of a discharge lamp driving apparatus according to a third embodiment of the present invention.

A discharge lamp driving apparatus according to a third embodiment of the present invention will be described with reference to FIG. 4. The discharge lamp driving apparatus shown in FIG. 4 operates basically in the same way as the apparatus shown in FIG. 2, but differs therefrom in that lamps 25*a* and 25*b* have their return side wires brought together into a common wire, and that respective lamp current detecting blocks 26 are provided at the grounding ends of the secondary side of two step-up transformers 23A and 23B whereby lamp currents at the secondary side of the step-up transformers 23A and 23B are detected for control. This structure reduces the amount of wires and wirings thus contributing to cost reduction. The discharge lamp driving apparatus shown in FIG. 4 includes step-up transformers provided in a number corresponding to the number of discharge lamps. The step-up transformers thus provided can be each downsized compared to a transformer adapted to drive multiple discharge lamps. Also, when the discharge lamp is long or shaped in U-letter, a so-called "floating circuit" may be used, in which case, a high voltage is applied to both ends of the discharge lamp and therefore the lamp current cannot be detected precisely at the both ends of the discharge lamp. In the floating circuit, the lamp current can be duly detected by providing the lamp current detecting block at the grounding end of the secondary side of the step-up transformer.

Figure 5:
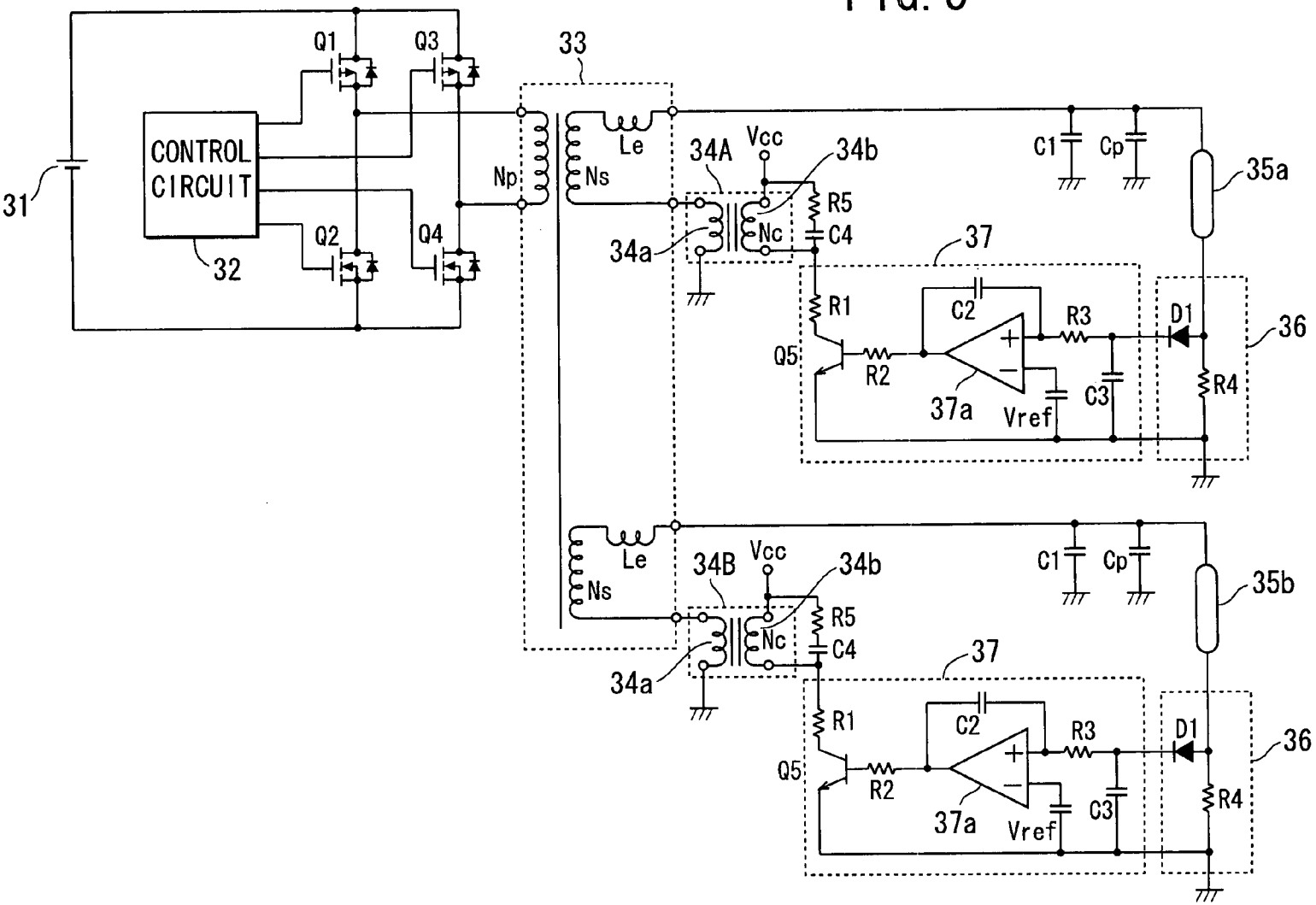
FIG. 5 is a block diagram of a discharge lamp driving apparatus according to a fourth embodiment of the present invention.
Figure 6A:
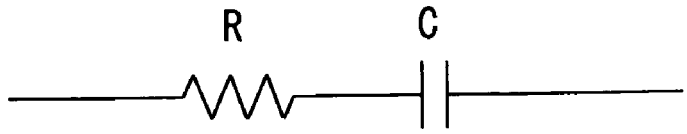
FIGS. 6A to 6D are alternatives at a feedback section of an operational amplifier.
Figure 6B:
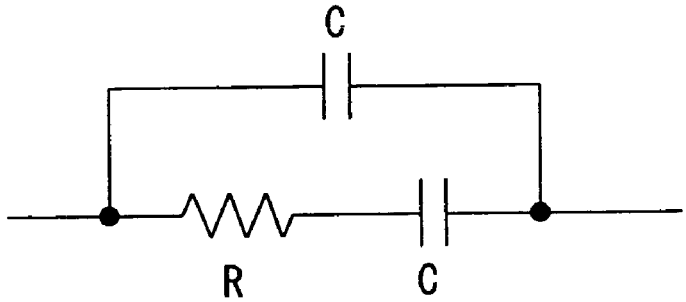
Figure 6C:
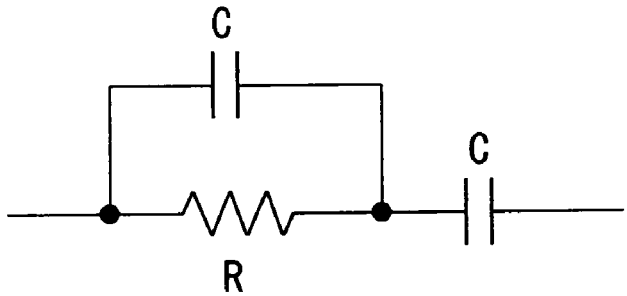
Figure 6D:
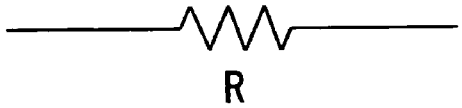

A discharge lamp driving apparatus according to a fourth embodiment of the present invention will be described with reference to FIG. 5. The discharge lamp driving apparatus shown in FIG. 5 operates basically in the same way as the apparatuses shown in FIGS. 2 to 4, but differs from, for example, the apparatus shown in FIG. 3 in that transformers 34A and 34B as variable inductance elements are provided at the grounding ends of the divided sections of the secondary side of step-up transformers 33. Since the transformers 34A and 34B as variable inductance elements are arranged at low voltage ends of the step-up transformer 33, the potential difference between coils 34*a* and 34*b* of the transformers 34A and 34B is small, which eases insulation in the transformers 34A and 34B thus achieving downsizing and cost reduction on the transformers 34A and 34B.

The capacitor C2 at the feedback section of the operational amplifier 7*a*/17*a*/27*a*/37*a* can be replaced with any one of circuits shown in FIGS. 6A to 6D.

While the present invention has been particularly shown and described with references to preferred embodiments thereof, it will be understood by those skilled in the art that various changes in form and details may be made therein without departing from the spirit and scope of the invention as defined by the appended claims.

What is claimed is:

1. A discharge lamp driving apparatus, comprising:

a DC power supply;

a control circuit;

at least one step-up transformer;

switching elements which are connected to the DC power supply and drive a primary side of the step-up transformer in accordance with a signal from the control circuit thereby driving at least two discharge lamps provided at a secondary side of the step-up transformer;

at least two variable inductance elements which each have its one end connected to one end of the secondary side of the step-up transformer whose other end is grounded, and which each have its other end connected to one end of each of the discharge lamps;

at least two series resonant circuits which are each constituted by a capacitor provided between each variable inductance element and each discharge lamp, leakage inductance of the step-up transformer, and inductance of the each variable inductance element;

at least two lamp current detecting blocks which are each provided at the other end of the each discharge lamp; and at least two lamp current controlling circuits which are each connected to an output of each lamp current detecting block, and which each have its output connected to the each variable inductance element, wherein the inductance of the each variable inductance element is varied thereby controlling a lamp current of the each discharge lamp, wherein a secondary side coil of the step-up transformer is divided into a plurality of sections, and the at least two series resonant circuits, the at least two lamp current detecting blocks, and the at least two lamp current controlling circuits are provided at respective sections of the secondary side coil of the step-up transformer.

2. The discharge lamp driving apparatus according to claim 1, wherein each of the lamp current detecting blocks is provided at the grounded other end of the secondary side of the step-up transformer.

3. The discharge lamp driving apparatus according to claim 1, wherein each of the variable inductance elements is provided at the grounded other end of the secondary side of the step-up transformer.

4. The discharge lamp driving apparatus according to claim 1, wherein the apparatus is incorporated in a backlight system for a liquid crystal display device.

5. A discharge lamp driving apparatus, comprising:

a DC power supply;

a control circuit;

at least one step-up transformer;

switching elements which are connected to the DC power supply and drive a primary side of the step-up transformer in accordance with a signal from the control circuit thereby driving at least two discharge lamps provided at a secondary side of the step-up transformer;

at least two variable inductance elements which each have its one end connected to one end of the secondary side of the step-up transformer whose other end is grounded, and which each have its other end connected to one end of each of the discharge lamps;

at least two series resonant circuits which are each constituted by a capacitor provided between each variable inductance element and each discharge lamp, leakage inductance of the step-up transformer, and inductance of the each variable inductance element;

at least two lamp current detecting blocks which are each provided at the other end of the each discharge lamp; and at least two lamp current controlling circuits which are each connected to an output of each lamp current detecting block, and which each have its output connected to the each variable inductance element, wherein the inductance of the each variable inductance element is varied thereby controlling a lamp current of the each discharge lamp, wherein each of the lamp current controlling circuits comprises an operational amplifier and a transistor which has its base terminal connected to an output of the operational amplifier and which has its collector terminal connected to the variable inductance element, and a signal from the lamp current detecting block, and a reference voltage are inputted to the operational amplifier, whereby the inductance of the variable inductance element is varied.

6. The discharge lamp driving apparatus according to claim 5, wherein each of the lamp current detecting blocks is provided at the grounded other end of the secondary side of the step-up transformer.

7. The discharge lamp driving apparatus according to claim 5, wherein each of the variable inductance elements is provided at the grounded other end of the secondary side of the step-up transformer.

8. The discharge lamp driving apparatus according to claim 5, wherein the apparatus is incorporated in a backlight system for a liquid crystal display device.

9. A discharge lamp driving apparatus, comprising:

a DC power supply;

a control circuit;

at least one step-up transformer;

switching elements which are connected to the DC power supply and drive a primary side of the step-up transformer in accordance with a signal from the control circuit thereby driving at least two discharge lamps provided at a secondary side of the step-up transformer;

at least two variable inductance elements which each have its one end connected to one end of the secondary side of the step-up transformer whose other end is grounded, and which each have its other end connected to one end of each of the discharge lamps;

at least two series resonant circuits which are each constituted by a capacitor provided between each variable inductance element and each discharge lamp, leakage inductance of the step-up transformer, and inductance of the each variable inductance element;

at least two lamp current detecting blocks which are each provided at the other end of the each discharge lamp; and at least two lamp current controlling circuits which are each connected to an output of each lamp current detecting block, and which each have its output connected to the each variable inductance element, wherein the inductance of the each variable inductance element is varied thereby controlling a lamp current of the each discharge lamp, wherein each of the variable inductance elements constitutes a transformer, and both ends of a control coil of the transformer are connected to a snubber circuit.

10. The discharge lamp driving apparatus according to claim 9, wherein each of the lamp current detecting blocks is provided at the grounded other end of the secondary side of the step-up transformer.

11. The discharge lamp driving apparatus according to claim 9, wherein each of the variable inductance elements is provided at the grounded other end of the secondary side of the step-up transformer.

12. The discharge lamp driving apparatus according to claim 9, wherein the apparatus is incorporated in a backlight system for a liquid crystal display device.

* * * * *